US005197752A

United States Patent [19]

Engelbert et al.

[11] Patent Number: 5,197,752

[45] Date of Patent: Mar. 30, 1993

[54] SKI

[75] Inventors: Spitaler Engelbert, Wr. Neudorf; Wittmann Heinz, Vienna; Alois Himmetsberger, Vienna; Henry Freisinger, Vienna; Helmut Wladar, Vienna; Andreas Janisch, Oeyenhausen; Karl Stritzl, Vienna; Roland Erdei, Weigelsdorf, all of Austria

[73] Assignee: HTM Sport- und Freizeitgeraete Gesellschaft m.b.H., Schwechat, Austria

[21] Appl. No.: 768,064

[22] PCT Filed: Jan. 17, 1991

[86] PCT No.: PCT/EP91/00076

§ 371 Date: Sep. 25, 1991

§ 102(e) Date: Sep. 25, 1991

[87] PCT Pub. No.: WO91/12056

PCT Pub. Date: Aug. 22, 1991

[30] Foreign Application Priority Data

Feb. 8, 1990 [AT] Austria ..... 267/90

[51] Int. Cl.[5] ..... A63C 5/00

[52] U.S. Cl. ..... 280/610; 280/602; 280/607; 280/617; 280/618; 280/636

[58] Field of Search ..... 280/636, 610, 607, 602, 280/617, 618

[56] References Cited

U.S. PATENT DOCUMENTS 5,016,901 5/1991 Mayr ..... 280/607

5,026,086 6/1991 Guers et al. ..... 280/607

FOREIGN PATENT DOCUMENTS 8303360 10/1983 World Int. Prop. O. ..... 280/602

*Primary Examiner*—Eric D. Culbreth

*Attorney, Agent, or Firm*—Flynn, Thiel, Boutell & Tanis

[57] ABSTRACT

A ski (1) which consists of a core (2), at least one upper surface layer and one lower surface layer. Recesses (6) are provided in the binding area, in which recesses containers (8) are fixed. Inserts to anchor fastening screws are inserted into the containers. Each insert consists of a layer of an elastomer material and of a layer of a fixed material, for example metal or glassfiber-reinforced plastic. In order to avoid in this ski (1) a drilling through the layer (10) of elastomer material and in order to also be able to stress this layer (10) with respect to tension and compression, the invention provides that this layer (10) is below the layer (9) of solid material and is fixedly connected both to the bottom wall (8*a*) of the container (8) and also to the layer (9) of solid material. A free space (s) is provided immediately above and between an upper surface (9A) of the layer (9) of solid material and a downwardly facing surface (7A) on a lid (7) covering each of the containers (8) to enable the application of tension to the layer (10).

5 Claims, 2 Drawing Sheets

SKI

FIELD OF THE INVENTION

The invention relates to a ski comprising a core and at least one upper and one lower surface layer, with recesses being provided in the binding area in the core, in which recesses containers are secured, into which containers inserts for anchoring the end sections of fastening screws for ski bindings are inserted, with each insert being composed of at least two layers, one layer of which consists of an elastomer material and the other layer of a fixed material, for example of metal and/or a glassfiber-reinforced plastic.

BACKGROUND OF THE INVENTION

Such a ski became available to the public through the Tyrolia brochure 1989/90 (No. 136471, "News and Highlights") or through an exhibition at the 1989 ISPO (Feb. 23 to 26, 1989), both corresponding to the teachings in U.S. Pat. No. 5,016,901. Of course, installation of the binding created certain difficulties in this ski, since one single step drill did not only have to drill through the upper surface layer but also through the layer of the elastomer material. Rubber particles, separated thereby from the last-mentioned layer, which particles after the drilling operation clogged at times the drill hole and, therefore, had to be removed prior to the insertion of the screw.

The purpose of the invention is to overcome these disadvantages and to provide a solution in which the layer of elastomer material needed to dampen vibrations no longer needs to be drilled through during the manufacture of the bore for the fastening screws.

SUMMARY OF THE INVENTION

A ski which includes a core having at least one upper surface layer thereon and one lower surface layer thereon and plural recesses in the core in a binding area. A hollow container is fixedly received in each recess, the container having a bottom wall and upstanding sidewalls and a lid. An insert is received in each of the hollow containers for connection in end sections of fastening screws extending through means defining an opening in the lid, which screws are used for fastening a ski binding to the binding area on the ski. Each of the inserts is composed of at least first and second layers, the first layer consisting of an elastomer material and the second layer consisting of a solid material. The first layer of elastomer material is oriented below the second layer of solid material. The elastomer material is fixedly connected to both the bottom wall of the container and also the second layer of solid material. Each of the second layers is supported for movement in said container toward and away from the bottom wall. The fastening screws are connected solely to the second layer of solid material. Means defining a free space is provided between the second layer and the lid so as to facilitate the movement of the second layer toward and away from the bottom wall and a subjection of the first layer of elastomer material to compressive and tension forces in response to the ski binding being forced to move relative to the ski.

BRIEF DESCRIPTION OF THE DRAWINGS

Exemplary embodiments of a ski of the invention are illustrated in the drawings.

DETAILED DESCRIPTION

Figure 1:
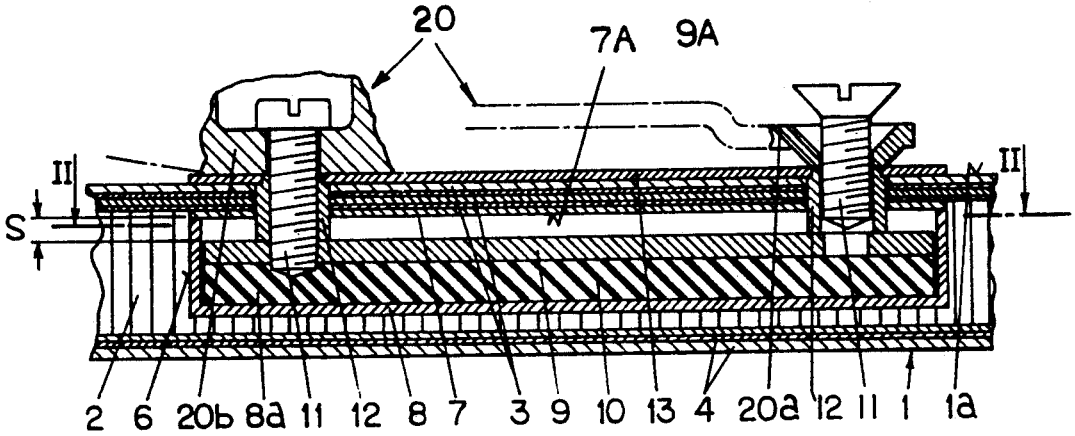
FIG. 1 is a longitudinal cross-sectional view taken along the line I—I of FIG. 2 of a first embodiment.
Figure 2:
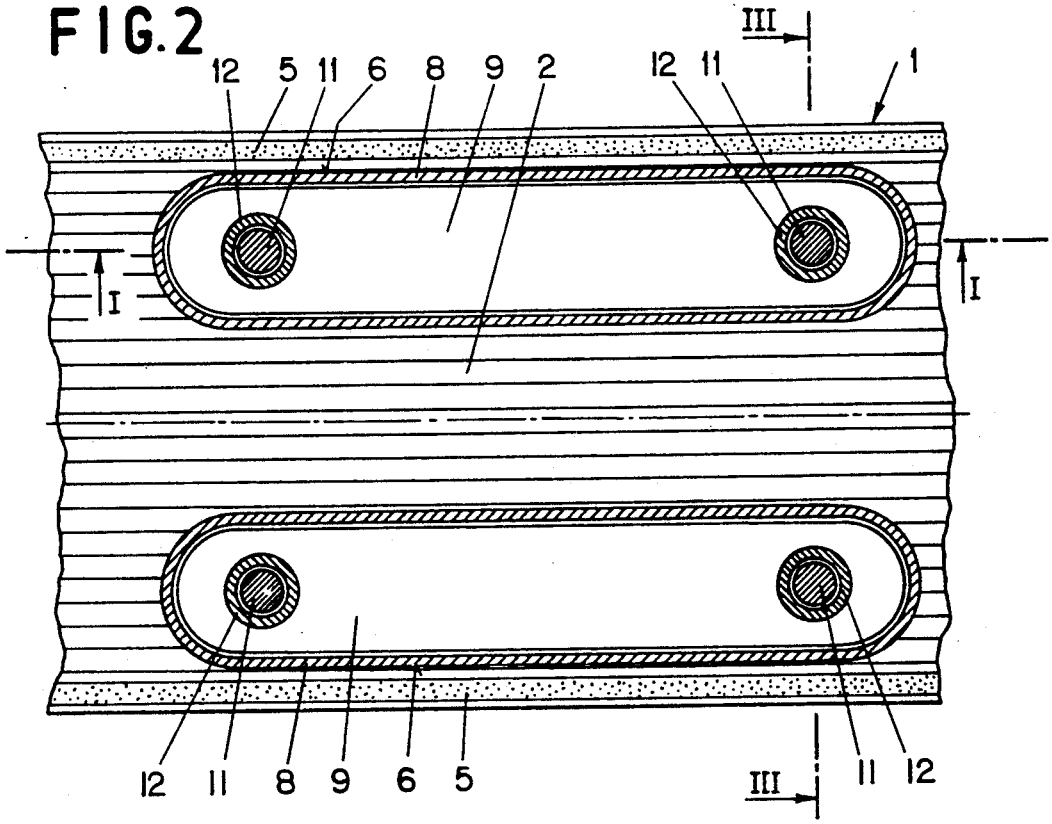
FIG. 2 is a cross-sectional view taken along the line II—II of FIG. 1.
Figure 3:
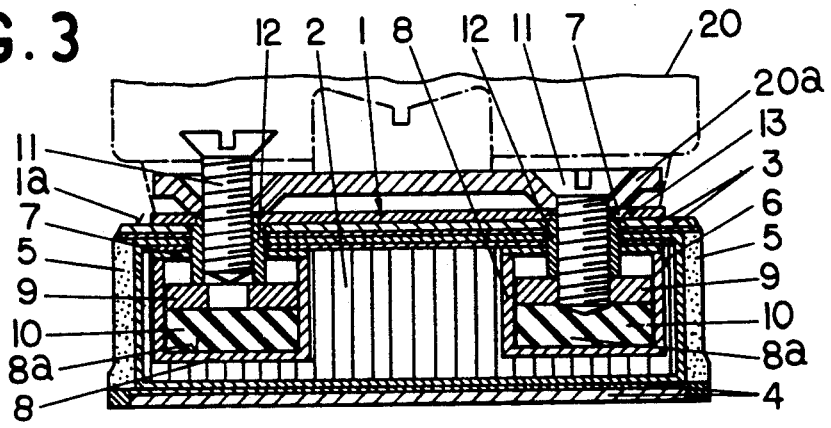
FIG. 3 is an associated cross-sectional view taken along the line III—III of FIG. 2, FIGS. 4 and 5 are enlarged cross-sectional views of two further embodiments in a nonstressed state, each of which corresponds with a detail of FIG. 3.

A ski is identified by the reference numeral 1 in FIGS. 1 to 3. It has a core 2 which on its upper side is covered by an upper belt 3 and on its underside by a lower belt 4. Side walls 5 are attached to the narrow side surfaces of the core 2. The design of such a ski is actually known and is not part of the subject matter of the present invention.

Two recesses 6 extending in longitudinal direction of the ski 1 are recessed in the core 2 of the ski 1, as this is shown in FIGS. 2 and 3. A container 8, each manufactured of sheet metal in the present exemplary embodiment, has a bottom wall 8*a* and upstanding sidewalls connected to the bottom wall and which open in an upward direction and are closed off by a lid 7, is fixed in each recess 6. An insert consisting of two layers, namely an upper layer 9 and a lower layer 10, is inserted into each container 8. The upper layer 9 consists of metal and/or of a glassfiber-reinforced plastic, whereas the lower layer 10 is manufactured of an elastomer material having a hardness value of 40–70 shore A. The lower layer 10 is fixedly connected, for example by gluing or vulcanizing, to both the bottom wall 8*a* of the container 8 and also to the upper layer 9. A free space s is provided immediately above and between an upwardly facing surface 9A of the upper layer 9 and a downwardly facing surface 7A of the lid 7 as shown in FIG. 1.

Each fastening screw 11 of a ski binding 20, which ski binding is only indicated by its base plate 20*a* and by a partial area of its jaw member 20*b*, is guided in a spacer sleeve 12 extending with clearance through the upper belt 3 and the lid 7 of the container 8, which spacer sleeve 12 is supported on the upper layer 9, projects beyond the upper side 1*a* of the ski and has its projecting end fixedly connected, as for example by welding, to a mounting plate 13. The mounting plate 13 rests, according to FIGS. 1 to 3, fully on the upper side 1*a* of the ski.

All three elements are in the position illustrated in FIG. 3 while the skier is skiing, if the ski slope is level. However, if the ski slope is undulating, the skier will, because of the undulations, be at times slightly lifted off from the ski 1. An upward pull is thereby applied to the fastening screws 11. However, this has the result that the lower layer 10 is slightly expanded. The vibrations of the ski binding, which vibrations are caused by the skier, are in this manner slightly damped by the lower layer 10. The vibrations die down sooner.

Figure 4:
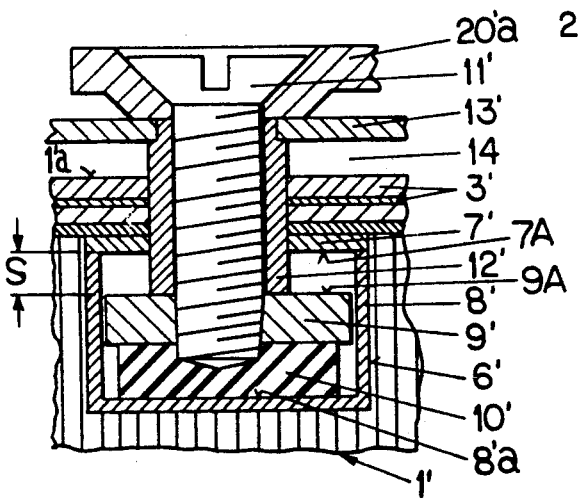
FIG. 4*a* illustrates the embodiment according to FIG. 4 during the highest level of stress.

The second embodiment of a ski 1', illustrated in a nonstressed state in FIG. 4, is distinguished by a space 14 existing between the mounting plate 13' and the upper side 1'*a* of the ski 1'. A further difference lies in the lower layer 10' having a laterally oriented clearance with respect to the container 8', which clearance makes it possible that the lower layer 10' cannot only be expanded but can also be slightly compressed. Thus, a damping of the movement of the binding in both directions can take place in this embodiment.

Figure 4A:
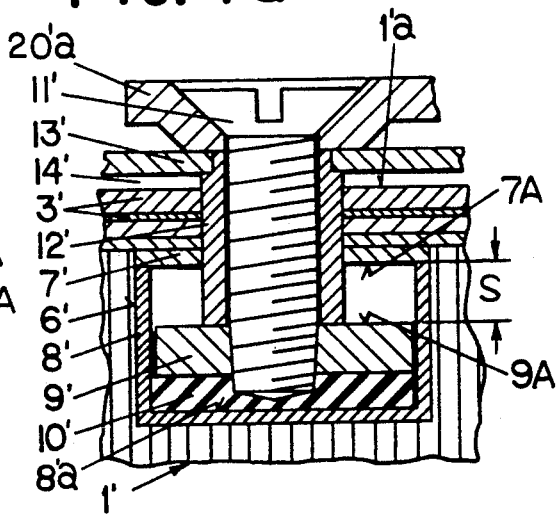

The height of the space 14 is also dimensioned such that in the case of the greatest loads the mounting plate 13' will always be spaced from the upper side 1'a of the ski. The practical dimension of this height has to occur in accordance with the material characteristics and the dimensions of the lower layer 10'. FIG. 4a shows this position, the space being here identified by the reference numeral 14'. It can thereby be easily recognized that the lower layer 10' fully fills out the available space in the container 8' and that the end of the screw 11' is still spaced from the bottom wall 8'a of the container 8'. In addition, the space between the surfaces 7A and 9A varies between s' (FIG. 4) during tension forces applied to the lower layer 10' and s'' (FIG. 4a) during compression forces applied to the lower layer 10'.

Figure 5:
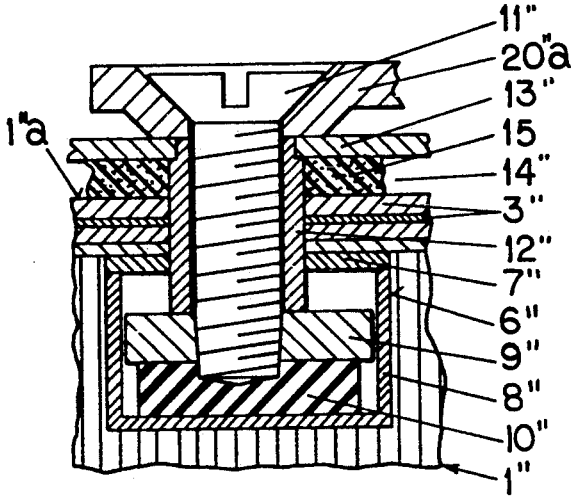

The third embodiment of a ski 1 shown in FIG. 5 is similar to the last-described one. The vibrations of the binding are also in this embodiment damped in both directions. It differs from the second embodiment only in a sealing layer 15 of an elastomer material, for example of sponge rubber, being arranged in the space 14''.

The invention is not to be limited to the abovedescribed exemplary embodiments illustrated in the drawings. Rather various modifications of these are possible without departing from the scope of the invention. For example, it would be conceivable to manufacture the container of metal by a die-casting process instead of drawing same of sheet metal. Furthermore, it is possible to manufacture the container by an injection-molding process of a, if necessary, glassfiber-reinforced plastic. Furthermore, the possibility exists to utilize rubber rings to seal off the spacer sleeves with respect to the upper side of the ski.

The embodiments of the invention in which an exclusive property or privilege is claimed are defined as follows:

1. A ski comprising a core having at least one upper surface layer thereon and one lower surface layer thereon, plural recesses in the core in a binding area, a hollow container fixedly received in each recess, said container having a bottom wall and upstanding sidewalls and a lid an insert received in each said hollow container for connection to end sections of fastening screws extending through means defining an opening in said lid and which are used for fastening a ski binding to the binding area of the ski, each said insert being composed of at least first and second layers, said first layer consisting of an elastomer material and said second layer consisting of a solid material, wherein said first layer of elastomer material is oriented below said second layer of solid material, said elastomer material being fixedly connected to both said bottom wall of said container and also said second layer of solid material, each said second layer is supported for movement in said container toward and away from said bottom wall, wherein said fastening screws are connected solely to said second layer of solid material, and wherein means defining a free space is provided between said second layer and said lid so as to facilitate said movement of said second layer toward and away from said bottom wall and a subjection of said first layer of elastomer material to compressive and tension forces in response to the ski binding being forced to move relative to the ski.

2. The ski according to claim 1, wherein said insert further includes a hollow spacer sleeve supported on said second layer of solid material in said free space and slidably through said opening in said lid, said hollow spacer sleeve receiving therethrough said fastening screw, said spacer sleeve also extending with clearance through means defining a further opening in said upper surface layer, and wherein the ski binding includes a mounting plate, an upper end of said spacer sleeve being fixedly connected to said mounting plate.

3. The ski according to claim 2, wherein said mounting plate is spaced above an upper side of the ski to define a further space therebetween.

4. The ski according to claim 3, wherein in said further space between said mounting plate and said upper side of the ski there is arranged a further layer of elastomer material.

5. The ski according to claim 1, wherein said first layer of elastomer material is fixedly connected to said second layer of solid material by at least one of gluing and vulcanizing the layer together.

* * * * *

UNITED STATES PATENT AND TRADEMARK OFFICE

CERTIFICATE OF CORRECTION

PATENT NO. : 5,197,752
DATED : March 30, 1993
INVENTOR(S) : Engelbert Spitaler, et al.

It is certified that error appears in the above-indentified patent and that said Letters Patent is hereby corrected as shown below:

On the title page, under item (19) "Engelbert" should be --Spitaler--.

On the title page, item [75] and in Column 1, Inventors:, change "Spitaler Engelbert" to ---Engelbert Spitaler---.

On the title page, item [75] and in Column 1, Inventors:, change "Wittmann Heinz" to ---Heinz Wittmann---.

Column 4, line 4; change "of" to ---on---.

Column 4, line 44; change "layer" to ---layers---.

Signed and Sealed this

First Day of February, 1994

Bruce Lehman

*Attest:*

BRUCE LEHMAN

*Attesting Officer*

*Commissioner of Patents and Trademarks*